US011224327B2

(12) United States Patent
Cheng

(10) Patent No.: US 11,224,327 B2
(45) Date of Patent: Jan. 18, 2022

(54) SPONGE FIXING MECHANISM FOR SPONGE MOP

(71) Applicant: DCLEAN ENTERPRISE CO., LTD., Taichung (TW)

(72) Inventor: Chao-Wei Cheng, Taichung (TW)

(73) Assignee: DCLEAN ENTERPRISE CO., LTD., Taichung (TW)

( * ) Notice: Subject to any disclaimer, the term of this patent is extended or adjusted under 35 U.S.C. 154(b) by 101 days.

(21) Appl. No.: 16/776,586

(22) Filed: Jan. 30, 2020

(65) Prior Publication Data

US 2021/0137343 A1 May 13, 2021

(30) Foreign Application Priority Data

Nov. 12, 2019 (TW) ..... 108214989

(51) Int. Cl.
*A47L 13/144* (2006.01)
*A47L 13/257* (2006.01)
*A47L 13/46* (2006.01)

(52) U.S. Cl.
CPC ..... *A47L 13/144* (2013.01); *A47L 13/257* (2013.01); *A47L 13/46* (2013.01)

(58) Field of Classification Search
USPC ..... 15/116.2, 119.2, 244.1
See application file for complete search history.

(56) References Cited

U.S. PATENT DOCUMENTS 2,708,283 A * 5/1955 Vaughn ..... A47L 1/06 15/244.1
2,715,237 A * 8/1955 Trindl ..... A47L 1/06 15/244.1
2,810,150 A * 10/1957 Ellman ..... B25G 3/00 15/244.1
3,031,705 A * 5/1962 Herman ..... A47L 13/146 15/119.2
4,118,824 A * 10/1978 Clement, Jr. ..... A47K 7/028 15/176.4
6,076,221 A * 6/2000 Bradshaw ..... A46B 7/04 15/160
6,240,590 B1 * 6/2001 Nesbit ..... A46B 17/02 15/145
9,565,985 B1 * 2/2017 Morad ..... A47L 13/144
(Continued)

FOREIGN PATENT DOCUMENTS

FR 2886125 * 12/2006
TW M276548 U 10/2005

*Primary Examiner* — Mark Spisich
(74) *Attorney, Agent, or Firm* — Muncy, Geissler, Olds & Lowe, P.C.

(57) ABSTRACT

A sponge fixing mechanism for sponge mop includes a first fastener and a second fastener. The first fastener has a chute and a mating surface in the chute. The chute has an outlet and an inlet respectively located at two opposite ends of the first fastener. The second fastener has a mating surface and is installed in the chute and detachably fastened to the first fastener with the mating surface thereof in sliding contact with the mating surface of the first fastener. One of the first fastener and the second fastener has a latching recess recessed from the mating surface thereof. The first fastener and the second fastener are fastened together by elastically engaging the latching protrusion into the latching recess.

15 Claims, 7 Drawing Sheets

(56) References Cited

U.S. PATENT DOCUMENTS

| | | | | |
|---|---|---|---|---|
| 10,653,285 | B1 * | 5/2020 | Ruble | A47L 13/08 |
| 2006/0037159 | A1 * | 2/2006 | Wang | A47L 13/42<br>15/144.1 |
| 2009/0038092 | A1 * | 2/2009 | Kennedy | A47L 13/16<br>15/104.94 |
| 2014/0311524 | A1 * | 10/2014 | Call | A46B 5/0095<br>134/6 |

* cited by examiner

SPONGE FIXING MECHANISM FOR SPONGE MOP

BACKGROUND OF THE INVENTION

1. Field of the Invention

The present invention relates to sponge mops, and more particularly to a sponge fixing mechanism for sponge mop.

2. Description of the Related Art

Taiwan patent M276548 discloses a sponge mop, which mainly comprises a handle for the user to hold, a squeezer located at the bottom end of the handle, a lever pivotally connected to the handle, two connecting rods with the top ends thereof respectively pivoted to the lever and the bottom ends thereof extending into a holder block of the squeezer, a sponge connected to the bottom ends of the connecting rods by a chuck and a pivot seat. In detail, the chuck is fixedly clamped on the top of the sponge, and the pivot seat is pivotally connected to the bottom end of the two connecting rods. The chuck and the sponge are detachably fixed to the pivot seat by a plurality of bolts. Thereby, when the user pivot the lever upward, the chuck and the sponge are moved toward the inside of the holder block of the squeezer, so that the sponge is squeezed by the roller of the squeezer.

However, when the user wants to replace the sponge, the user needs to dismount the bolts and remove the chuck with the sponge, and then replace it with a new sponge and fix it with the bolts. In this way, the process of dismounting the sponge not only requires the use of tools but will also be hindered by the holder block of the squeezer. It may also make the process of dismounting the sponge more inconvenient due to the long handle and the space it takes.

SUMMARY OF THE INVENTION

The present invention has been accomplished under the circumstances in view. It is the main object of the present invention to provide a sponge fixing mechanism for sponge mop, which allows users to change the sponge more easily and conveniently.

To achieve this and other objects of the present invention, a sponge fixing mechanism for sponge mop comprises a first fastener and a second fastener. The first fastener comprises a chute, and a mating surface located in the chute. The chute has an upper opening, and an inlet and an outlet respectively located at two opposite ends of the first fastener. The mating surface faces the upper opening. The second fastener comprises a mating surface. The second fastener is installed in the chute and detachably fastened to the first fastener with the mating surface of the second fastener in sliding contact with the mating surface of the first fastener. Furthermore, one of the first fastener and the second fastener comprises a latching recess recessed from the associating mating surface, and the other of the first fastener and the second fastener comprises a latching protrusion protruded from the associating mating surface. The first fastener and the second fastener are fastened together by elastically engaging the latching protrusion into the latching recess. In other words, the first fastener and second fastener of the sponge fixing mechanism of the present invention are mated with each other in a similar way to a slide rail, and the latching protrusion and the latching recess are elastically engaged with each other to achieve a detachable fixing effect, so that users can easily and conveniently change the sponge. In the preferred embodiment of the present invention, the first fastener has the latching recess (that is, the latching recess is located in the chute), and the second fastener has the latching protrusion. However, the invention is not limited to this.

With this, one of the first fastener and the second fastener is used to set a sponge, and the other is used to connect to the connecting rods that can cause the sponge to be squeezed by the squeezer. In the preferred embodiment of the present invention, the first fastener is used to connect the connecting rods, and the second fastener is used to set the sponge. Take this configuration as an example, when the user wants to replace the sponge, the user simply needs to apply a force to the second fastener in the direction of the chute inlet to cause separation of the latching protrusion from the latching recess, thereby unlocking the first fastener and the second fastener, for allowing the second fastener to slide away from the chute of the first fastener. In this way, the second fastener with the sponge are separated from the other components (such as squeezer, handle, etc.) of the sponge mop. At this time, the user can use the tool to remove the sponge from the second fastener conveniently without hindrance. Alternatively, the second fastener and the sponge can be regarded as a set of consumables without the need of removing the sponge from the second fastener. Then, the user does not need to use tools, but only needs to fix another set of sponge and second fastener to the first fastener directly by the aforementioned sliding connection method. In other words, the sponge fixing mechanism of the present invention allows the user to easily and conveniently replace the sponge.

Preferably, the latching recess and the latching protrusion may respectively have an inner guide surface and an outer guide surface corresponding to each other. The inner guide surface and the outer guide surface are planes inclined with respect to the mating surface. Alternatively, the inner guide surface and the outer guide surface can be curved surfaces. Furthermore, the latching protrusion can be located on a cantilever so that the latching protrusion can be detachably engaged in the latching recess by elastic swinging of the cantilever. Both of the aforementioned features help make the latching recess and latching protrusions more smoothly engage with each other and separate from each other.

Preferably, the chute of the first fastener and the second fastener have a stepped shape with a wider upper part and a narrower lower part, that is, the chute comprises a narrow chute portion and a wide chute portion disposed between the narrow chute portion and the mating surface, and the second fastener comprises a wide portion and a narrow portion corresponding to the wide chute portion and the narrow chute portion. The second fastener further comprises a stop portion located at one end of the narrow portion. The width of the stop portion is larger than the width of the narrow portion. Thus, when the first fastener and the second fastener are fastened together, the stop portion is disposed outside the chute and abutted at the inlet of the chute. Furthermore, the chute of the first fastener comprises a convex strip protruded from a bottom surface thereof, thereby forming a groove on the bottom surface adjacent to the convex strip. The second fastener further comprises a rib protruded from its mating surface and set in the groove of the first fastener. The aforesaid features help to make the first fastener and the second fastener slide and fit with each other more stably, and it can also generate a fool-proof function to allow users to easily mate the first fastener and the second fastener with each other.

Preferably, the second fastener has opposing front end and rear end. The stop portion is essentially located at the rear end. The cantilever is disposed in a slot of the second fastener and extends from a front wall surface of the slot that faces the rear end toward a rear wall surface that faces the front end of the slot. With the aforementioned fool-proof function, the second fastener can only enter the chute inlet with its front end and be mutually fixed with the first fastener. That is, the second fastener slides the latching protrusion in a direction opposite to the extending direction of the cantilever into engagement with the latching recess. On the contrary, the second fastener slides in the extending direction of the cantilever to separate the latching protrusion from the latching recess. In this way, the latching recess and the latching protrusion can be more smoothly engaged with each other and separated from each other.

Preferably, the first fastener further comprises two perforations located on the bottom surface of the chute and respectively disposed adjacent to the inlet and outlet of the chute, that is, the two perforations are further away from the upper opening of the chute than the mating surface of the first fastener, and are used for the mounting of the two connecting rods that are provided for driving the sponge to be squeezed by the squeezer, preventing interference with the second fastener.

Other advantages and features of the present invention will be fully understood by reference to the following specification in conjunction with the accompanying drawings, in which like reference signs denote like components of structure.

DETAILED DESCRIPTION OF THE INVENTION

Figure 1:
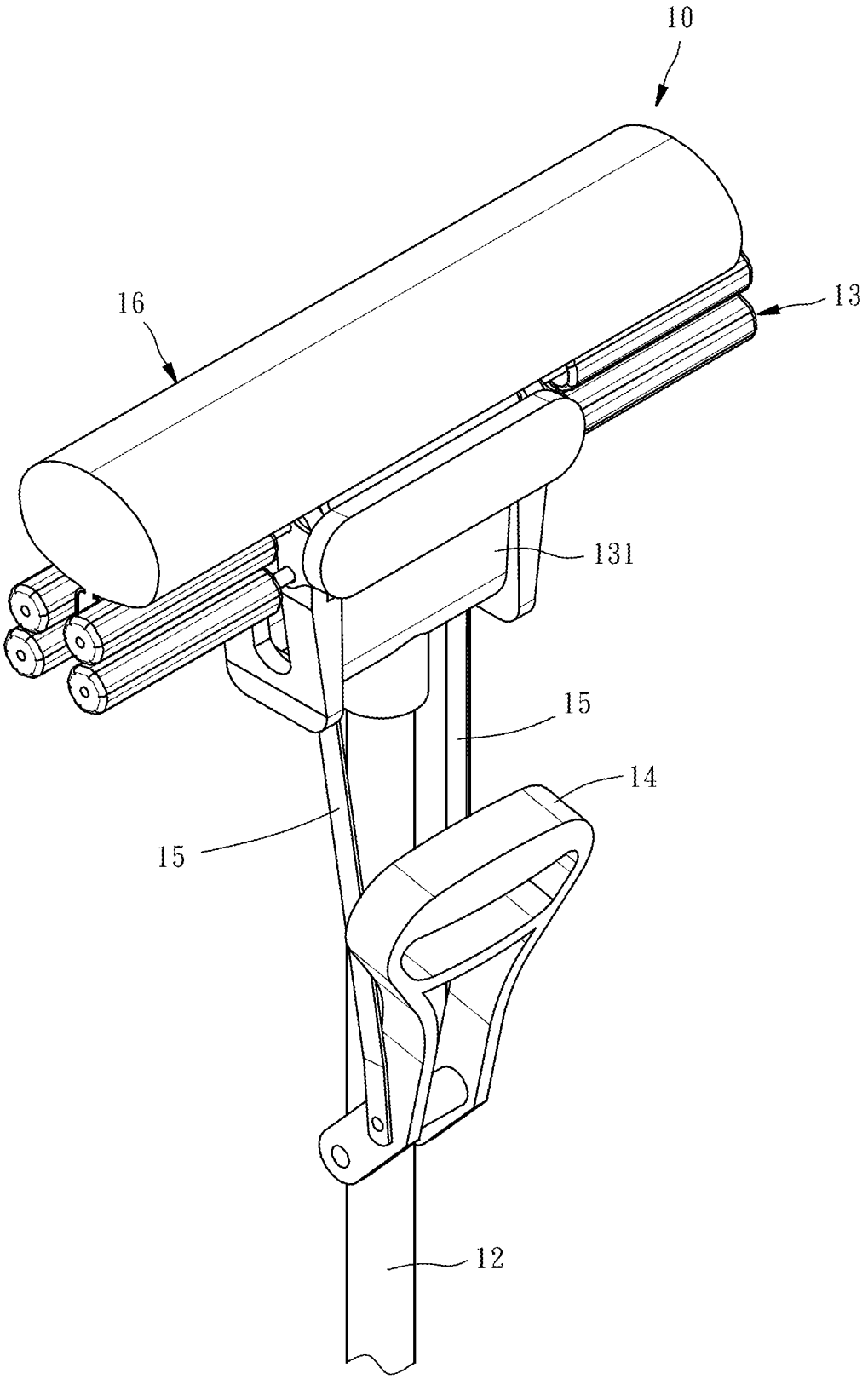
FIG. 1 is an elevational assembly view of a sponge mop with a sponge fixing mechanism provided by a preferred embodiment of the present invention.
Figure 2:
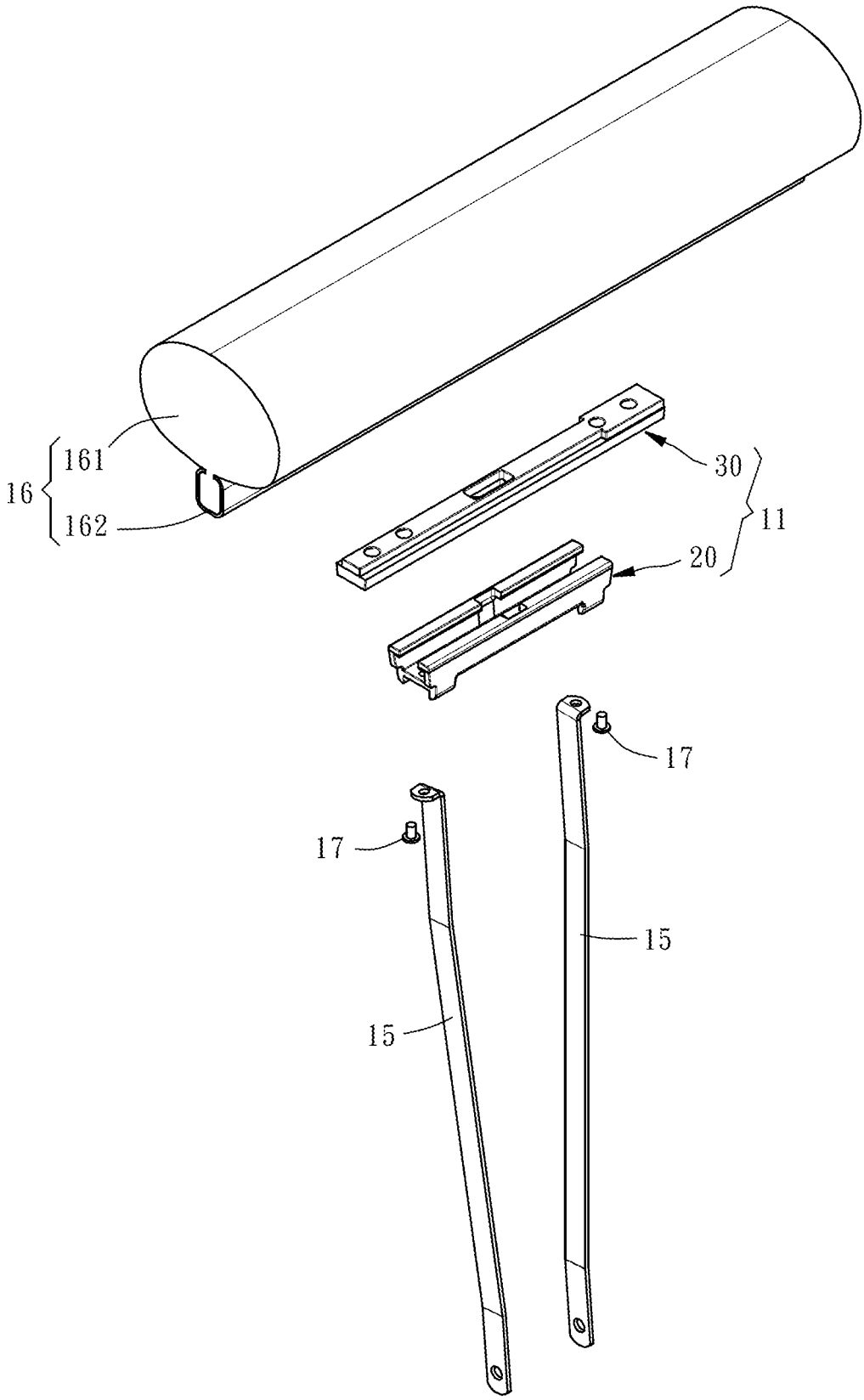
FIG. 2 is an exploded view of a sponge unit, two connecting rods, two rivets and the sponge fixing mechanism.
Figure 3:
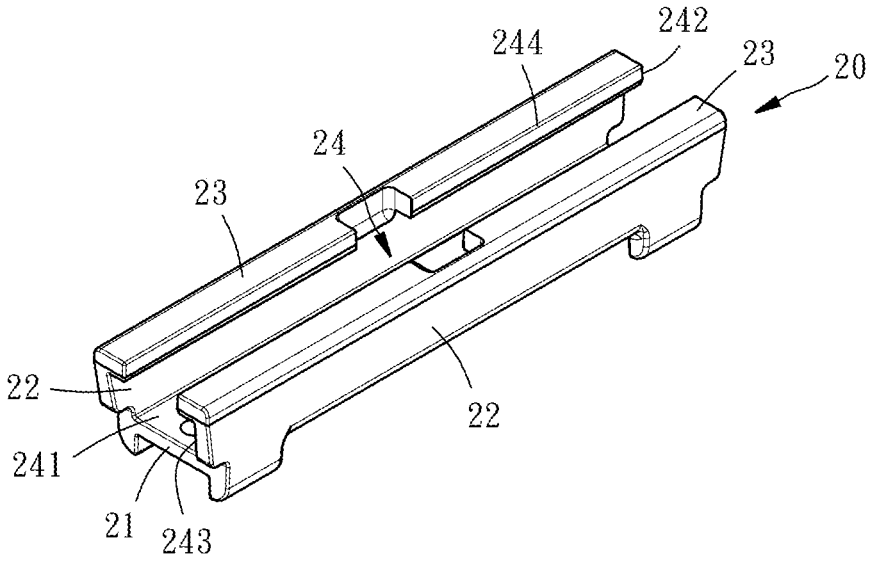
FIG. 3 is an elevational view of the first fastener of the sponge fixing mechanism.
Figure 4:
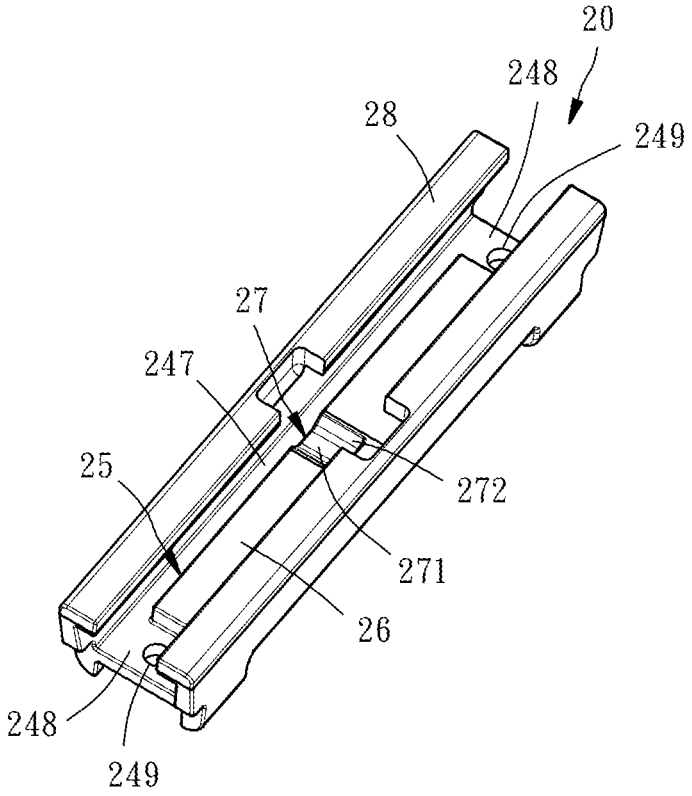
FIG. 4 corresponds to FIG. 3 when viewed from another angle.
Figure 5:
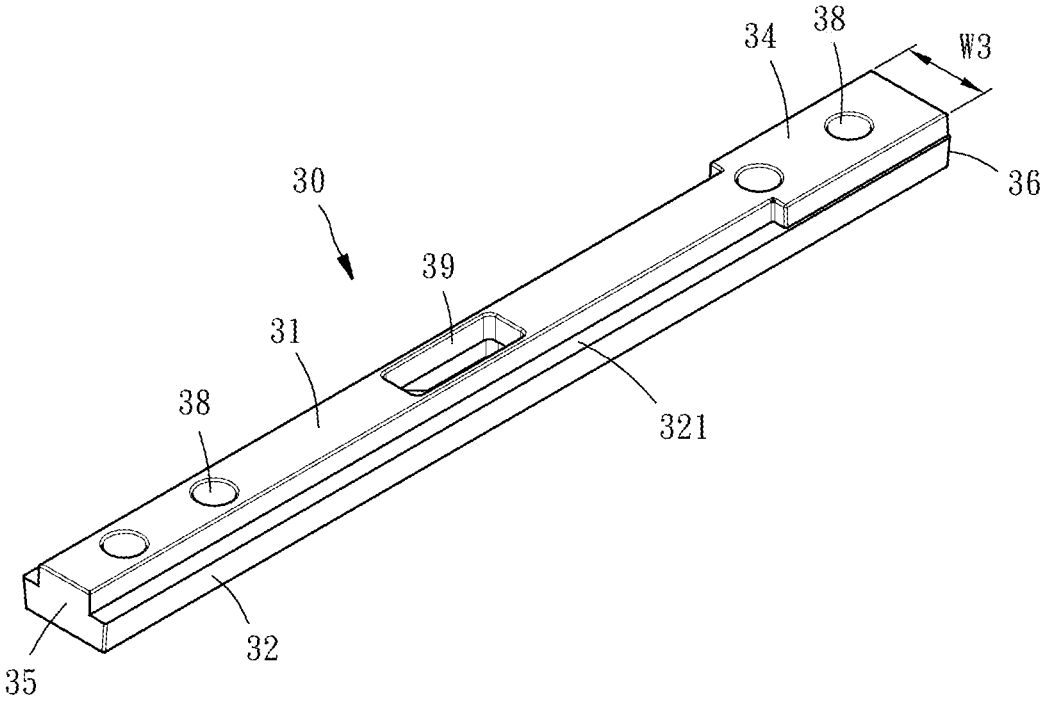
FIG. 5 is an elevational view of the second fastener of the sponge fixing mechanism.
Figure 6:
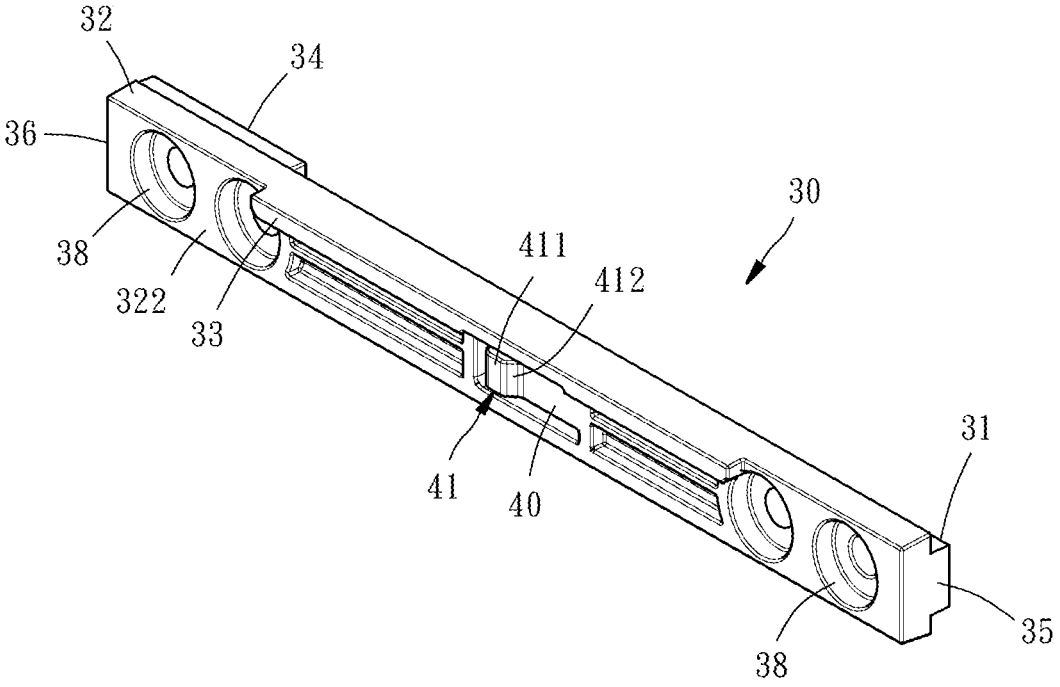
FIG. 6 corresponds to FIG. 5 when viewed from another angle.

Referring to FIGS. 1 and 2, a sponge fixing mechanism 11 of a sponge mop 10 provided by a preferred embodiment of the present invention comprises a first fastener 20 as shown in FIGS. 3 and 4 and a second fastener 30 as shown in FIGS. 5 and 6. The material of the first fastener 20 and the second fastener 30 can be (but not limited to) plastic. The first fastener 20 is used to install in the main structure of the sponge mop 10. More specifically, the main structure of the sponge mop 10 described above comprises a handle 12 for holding by the user, a squeezer 13 provided at one end of the handle 12, a lever 14 pivoted on the handle 12 and two connecting rods 15 connected between the lever 14 and the first fastener 20. This part is similar to conventional sponge mops, and the applicant will not describe it in detail here. The second fastener 30 is used to hold a sponge unit 16 so that the sponge unit 16 is detachably fixed to the first fastener 20 through the second fastener 30, as described in detail below.

Figure 7:
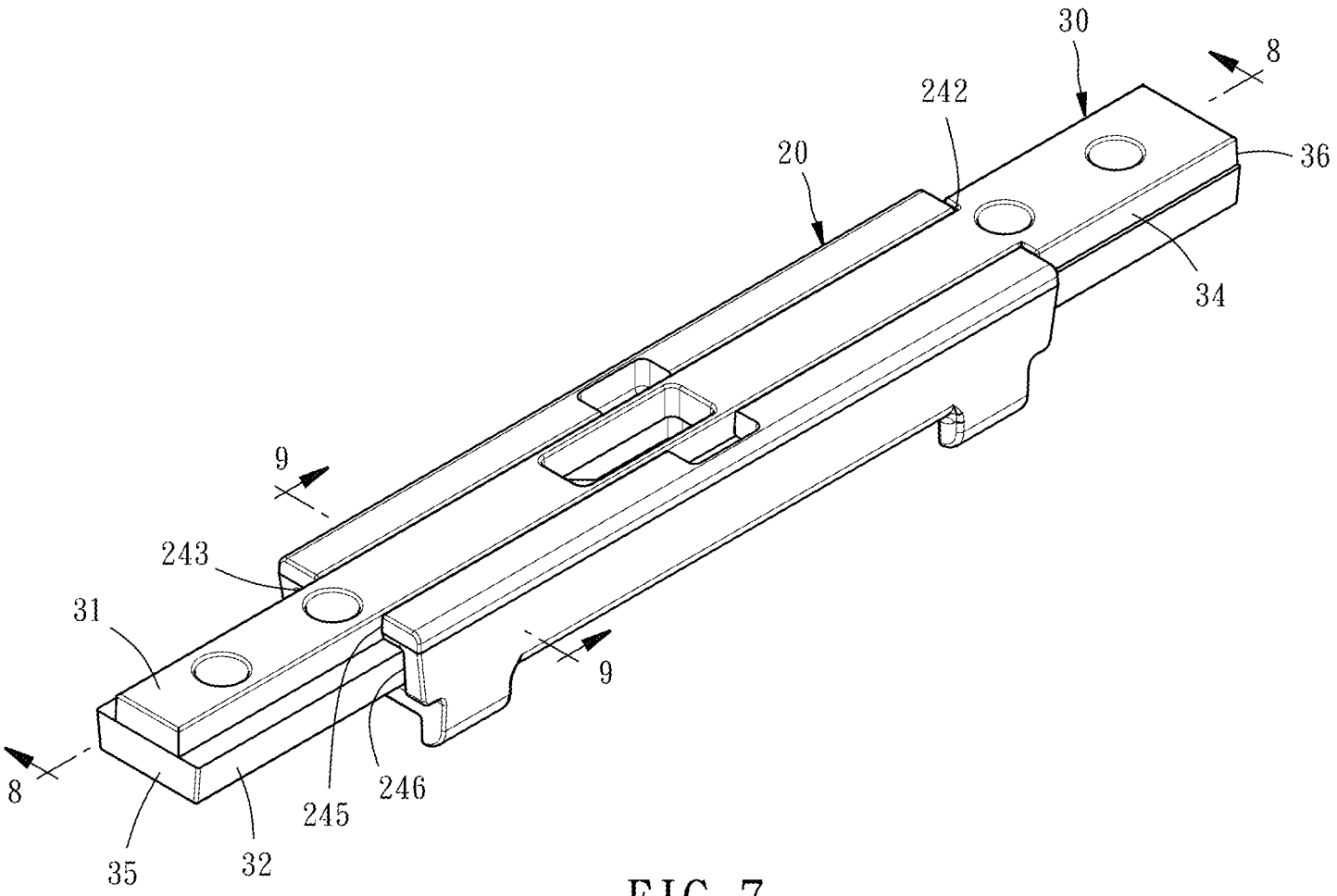
FIG. 7 is an elevational assembly view of the sponge fixing mechanism.
Figure 8:
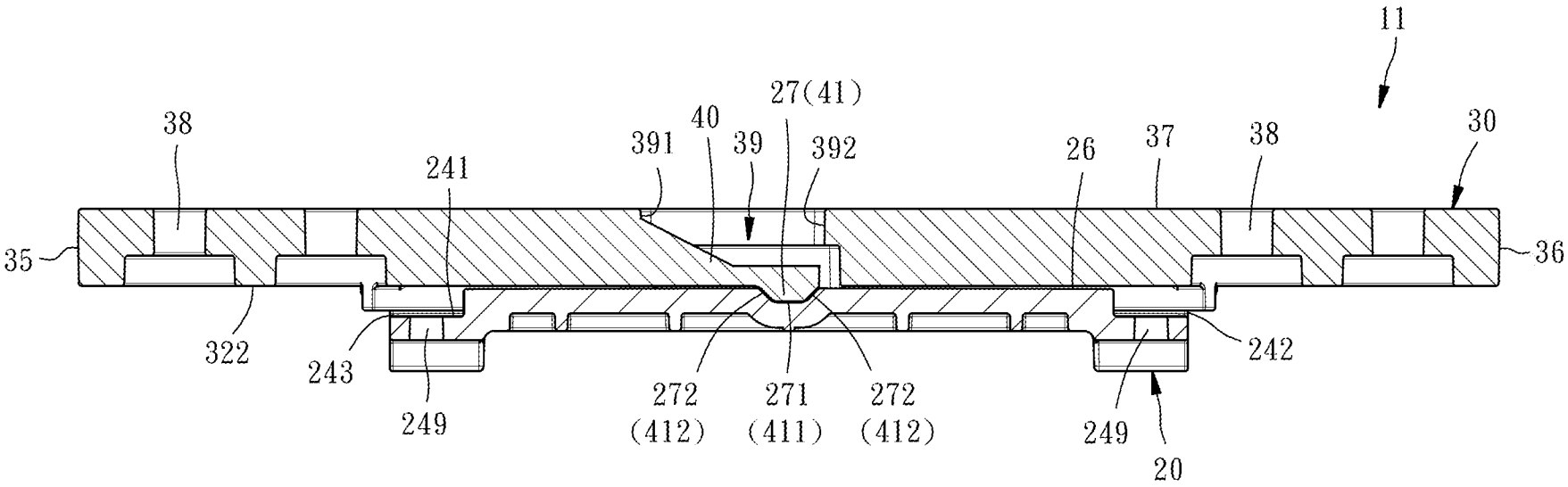
FIG. 8 is a sectional view taken along line 8-8 of FIG. 7.
Figure 9:
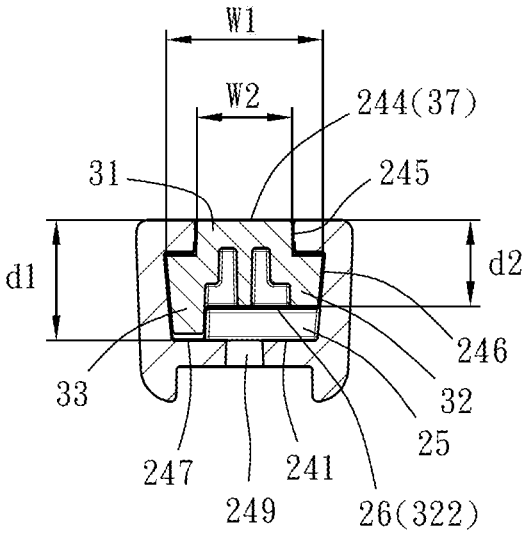
FIG. 9 is a sectional view taken along line 9-9 of FIG. 7.

Referring to FIGS. 3 and 4 and FIGS. 7-9, the first fastener 20 comprises a base 21, two opposing side walls 22 extending upward from a top surface of the base 21, two top walls 23 respectively and laterally extending from the top of the side walls 22 toward each other, a stepped chute 24 with a narrow upper width and a wide lower width surrounded by the base 21, the two side walls 22 and the two top walls 23, a convex strip 25 protruded from a bottom surface 241 of the chute 24 (i.e., the top surface of the base 21), a mating surface 26 located on a top side of the convex strip 25, and a latching recess 27 recessed from the center of the mating surface 26. More specifically, the chute 24 has an inlet 242 and an outlet 243 respectively located at the two ends of the first fastener 20, and an upper opening 244 located on a top surface 28 (that is, the top surface of the two top walls 23) of the first fastener 20. As shown in FIG. 9, the chute 24 has a narrow chute portion 245 extending from the top surface 28 toward the mating surface 26, and a wide chute portion 246 disposed between the narrow chute portion 245 and the mating surface 26. The width W1 of the wide chute portion 246 is larger than the width W2 of the narrow chute portion 245. In addition, the convex strip 25 is connected to one of the side walls 22, so that a groove 247 is formed on a bottom surface 241 of the chute 24 between the convex strip 25 and the other side wall 22. As shown in FIG. 4, the convex strip 25 is shorter than the chute 24, so that the bottom surface 241 is provided with two installation blocks 248 located between the two ends of the convex strip 25 and the inlet 242 and outlet 243 of the chute 24. Furthermore, the bottom surface 241 is provided with two perforations 249 respectively located on the installation blocks 248. As shown in FIG. 2, the aforesaid two connecting rods 15 are respectively fixedly fastened to the two perforations 249 with two rivets 17, so that the first fastener 20 is set in a body 131 of the squeezer 13.

Referring to FIGS. 5-9, the second fastener 30 has a stepped shape corresponding to the shape of the chute 24 with a narrow upper width and a wide lower width, that is, the cross-sectional shape of the second fastener 30 has a narrow portion 31, a wide portion 32 and a rib 33, which are complementary to the aforementioned narrow chute portion 245, wide chute portion 246 and groove 247. However, the length of the second fastener 30 is larger than the length of the first fastener 20. The second fastener 30 further comprises a stop portion 34 having a width between the width W2 of the narrow portion 31 and the width W1 of the wide portion 32. Specifically, the narrow portion 31 protrudes from a top surface 321 of the wide portion 32, the rib 33 protrudes from a bottom surface 322 of the wide portion 32 (i.e., the mating surface of the second fastener), one lateral side of the rib 33 is flush with one lateral side of the wide portion 32, and the stop portion 34 is located on the top surface 321 of the wide portion 32 and at one end of the narrow portion 31. The second fastener 30 has opposing front end 35 and rear end 36. The stop portion 34 is essentially located at the rear end 36. In FIG. 9, the width of the wide portion 32 and the width of the wide chute portion 246 are referenced by W1, that is, the two are approximately equal. Actually, the width of the wide portion 32 is slightly smaller than the width of the wide chute portion 246. Similarly, the width of the narrow portion 31 and the width of the narrow chute portion 245 are both denoted by the reference W2, that is, the two are approximately equal. Actually, the width of the narrow portion 31 is slightly smaller than the width of the narrow chute portion 245. As shown in FIG. 8, the second fastener 30 further comprises four mounting holes 38 and a slot 39 cut through the top surface 37 and the mating surface 322. The fourth mounting holes 38 are arranged in two pairs respectively disposed adjacent to the front end 35 and rear end 36 of the second fastener 30. The slot 39 is located in the center of the second fastener 30, which is provided with a cantilever 40. The slot 39 front wall surface 391 facing the rear end 36 and a rear wall surface 392 facing the front end 35. The cantilever 40 extends from the front wall surface 391 toward the rear wall surface 392. The bottom surface of the cantilever 40 is flush with the mating surface 322 with a latching protrusion 41 protruded therefrom, that is, the latching protrusion 41 protrudes from the mating surface 322.

As described above, the second fastener 30 is used to set the sponge unit 16. As shown in FIG. 2, the sponge unit 16 comprises a sponge 161, and a clamping member 162 fixedly held at the bottom of the sponge 161. The sponge unit 16 is installed on the second fastener 30 through four bolts (not shown) that are respectively inserted through the mounting holes 38 of the second fastener 30 and locked to the clamping member 162. The second fastener 30 is detachably fixed to the first fastener 20, so that the sponge unit 16 is combined with other components of the mop. In detail, the second fastener 30 enters the inlet 242 of the chute 24 with its front end 35, and the second fastener 30 is installed in the chute 24 by sliding its mating surface 322 along the mating surface 26 of the first fastener 20. During this process, the wide portion 32, narrow portion 31 and rib 33 of the second fastener 30 are respectively set in the wide chute portion 246, narrow chute portion 245 and groove 247 of the chute 24, and latching protrusion 41 is abutted by the mating surface 26 of the first fastener 20 to force the cantilever 40 to elastically swing in the direction of the top surface 37, so that the latching protrusion 41 does not hinder the sliding of the second fastener 30. Since the width W3 of the stop portion 34 of the second fastener 30 is larger than the width W2 of the narrow chute portion 245 of the chute 24, when the relative positions of the first fastener 20 and the second fastener 30 are as shown in FIG. 7 and FIG. 8, the stop portion 34 of the second fastener 30 is disposed outside the chute 24 and abutted at the inlet 242 of the chute 24, so that the second fastener 30 can no longer slide in the direction toward its front end 35. At this time, the latching protrusion 41 is located at the latching recess 27 and released from the mating surface 26 of the first fastener 20, the cantilever 40 is elastically returned so that the latching protrusion 41 is engaged in the latching recess 27. In this way, the first fastener 20 and the second fastener 30 are fixed to each other, and the sponge unit 16 is disposed outside the upper opening 244 of the first fastener 20, and thus, the sponge unit 16 can be driven by the two connecting rods 15 and then squeezed by the squeezer 13 when the user pulls the lever 14.

When the user wants to replace the sponge unit 16, as long as a force is applied to the second fastener 30 in the direction of the rear end 36 of the second fastener 30, the latching protrusion 41 can be easily removed from the latching recess 27 to unlock the fixed relationship between the first fastener 20 and the second fastener 30, allowing removal of the second fastener 30 from the chute 24 of the inlet 242 to separate the second fastener 30 from the first fastener 20. In this way, the second fastener 30 with the sponge unit 16 are separated from the other components of the mop. At this time, the user can use the tool to remove the sponge unit 16 from the second fastener 30 conveniently without hindrance. Alternatively, the second fastener 30 and the sponge unit 16 can be regarded as a set of consumables without the need of removing the sponge unit 16 from the second fastener 30. Then, the user does not need to use tools, but only needs to fix another set of sponge unit 16 and second fastener 30 to the first fastener 20 directly by the aforementioned sliding connection method.

As shown in FIG. 8, the latching recess 27 of the first fastener 20 has an inner bottom surface 271, and two inner guide surfaces 272 respectively extended from two opposite sides of the inner bottom surface 271 to the mating surface 26. The latching protrusion 41 of the second fastener 30 has an outer bottom surface 411 and two outer guide surfaces 412 corresponding to the inner bottom surface 271 and inner guide surfaces 272 of the latching recess 27 respectively. When the latching protrusion 41 is engaged in the latching recess 27, the inner bottom surface 271 and inner guide surfaces 272 of the latching recess 27 are disposed in contact with the outer bottom surface 411 and outer guide surfaces 412 of the latching protrusion 41 respectively. In the present preferred embodiment, each of the inner guide surface 272 and the outer guide surfaces 412 substantially a plane inclined with respect to the mating surfaces 26, 322.

Each of the inner guide surface 272 and the outer guide surfaces 412 can also be a curved surface, or any other shape that can guide latching protrusion 41 and the latching recess 27 to slide relative to each other.

In addition, since the second fastener 30 has the aforesaid stop portion 34, and the first fastener 20 and the second fastener 30 are correspondingly provided with the groove 247 and the rib 33, such a design can generate a fool-proof function, allowing the second fastener 30 can only be installed into the chute 24 by inserting its front end 35 into the inlet 242 of the chute 24 of the first fastener 20. In other words, the second fastener 30 slides in a direction opposite to the extending direction of the cantilever 40 (from the inlet 242 toward the outlet 243) to force the latching protrusion 41 into engagement with the latching recess 27. On the contrary, the second fastener 30 slides in the extending direction of the cantilever 40 (from the outlet 243 toward the inlet 242) to separate the latching protrusion 41 from the latching recess 27. In this way, the latching recess 27 and the latching protrusion 41 can be more smoothly engaged with each other and separated from each other. The aforementioned design is more helpful for the first fastener 20 and the second fastener 30 to slide toward each other and be fixed to each other more stably.

Moreover, since the perforations 249 of the first fastener 20 for the fixation of the connecting rods 15 are located on the bottom surface 241 with a gap from the mating surface 26, that is, as shown in FIG. 9, the distance d1 between the bottom surface 241 and the upper opening 244 of the chute 24 is larger than the distance d2 between the mating surface 26 and the upper opening 244. This can prevent the two connecting rods 15 and the two rivets 17 from protruding from the mating surface 26 to interfere with the second fastener 30.

In conclusion, the first fastener 20 and second fastener 30 of the sponge fixing mechanism 11 of the present invention are mated with each other in a similar way to a slide rail, and the latching protrusion 41 and the latching recess 27 are elastically engaged with each other to achieve a detachable fixing effect, so that users can easily and conveniently change the sponge.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A sponge fixing mechanism for sponge mop, comprising:

a first fastener comprising a chute and a mating surface disposed in said chute, said chute comprising an upper opening and an inlet and an outlet respectively located on two opposite ends of said first fastener, said mating surface of said first fastener facing said upper opening;

a second fastener comprising a mating surface, said second fastener being installed in said chute and detachably fastened to said first fastener with said mating surface of said second fastener in sliding contact with said mating surface of said first fastener; and a sponge unit located in said second fastener;

wherein one of said first fastener and said second fastener comprises a latching recess recessed from the associating said mating surface, the other of said first fastener and said second fastener comprises a latching protrusion protruded from the associating said mating surface, said first fastener and said second fastener being fastened together by elastically engaging said latching protrusion into said latching recess, wherein said latching recess comprises an inner bottom surface, and two inner guide surfaces respectively extended from two opposite sides of said inner bottom surface to the associating said mating surface; said latching protrusion comprises an outer bottom surface and two outer guide surfaces corresponding to said inner bottom surface and said inner guide surfaces of said latching recess respectively.

2. The sponge fixing mechanism for sponge mop as claimed in claim 1, wherein said inner guide surfaces and said outer guide surfaces are plane inclined with respect to said mating surface.

3. The sponge fixing mechanism for sponge mop as claimed in claim 2, wherein said latching protrusion is provided on a cantilever, and elastically and detachably engaged into said latching recess by elastic swinging of said cantilever.

4. The sponge fixing mechanism for sponge mop as claimed in claim 2, wherein said first fastener further comprises a top surface; said upper opening of said chute is located on said top surface; said chute comprises a narrow chute portion extending from said top surface toward said mating surface and a wide chute portion disposed between said narrow chute portion and the associating said mating surface, a width of said wide chute portion being larger than a width of said narrow chute portion; said second fastener comprises a wide portion and a narrow portion protruding from a top surface of said wide portion, a width of said wide portion being larger than a width of said narrow portion; said wide portion and said narrow portion of said second fastener are respectively located on said wide chute portion and said narrow chute portion of said chute.

5. The sponge fixing mechanism for sponge mop as claimed in claim 4, wherein said second fastener further comprises a top surface located on said wide portion and a stop portion located at one end of said narrow portion, a width of said stop portion being larger than the width of said narrow portion and larger than the width of said narrow chute portion of said chute; when said first fastener and said second fastener are fixed to each other, said stop portion of said second fastener is disposed outside of said chute and abutted at said inlet of said chute.

6. The sponge fixing mechanism for sponge mop as claimed in claim 5, wherein said chute of said first fastener comprises a bottom surface, a convex strip protruded from said bottom surface of said chute, and a groove located on said bottom surface of said chute adjacent to said convex strip, said mating surface of said first fastener being located on said convex strip; said second fastener further comprises a rib protruded from a bottom surface of said wide portion, said rib being set in said groove of said first fastener.

7. The sponge fixing mechanism for sponge mop as claimed in claim 6, wherein said first fastener further comprises two perforations located on said bottom surface of said chute, said two perforations being respectively disposed between two opposite ends of said convex strip and said inlet and said outlet of said chute for the mounting of two connecting rods that are used to move the sponge fixing mechanism.

8. The sponge fixing mechanism for sponge mop as claimed in claim 7, wherein said latching protrusion is located on a cantilever for detachably and elastically engaging into said latching recess by elastic swinging of said cantilever.

9. The sponge fixing mechanism for sponge mop as claimed in claim 8, wherein said second fastener further comprises a slot, a front end and a rear end opposite to said front end, said slot comprising a front wall surface facing said rear end and a rear wall surface facing said front end; said stop portion is essentially located at said rear end of said second fastener; said cantilever extends from said front wall surface of said slot toward said rear wall surface of said slot.

10. The sponge fixing mechanism for sponge mop as claimed in claim 4, wherein said chute of said first fastener comprises a bottom surface, a convex strip protruded from said bottom surface of said chute, and a groove located on said bottom surface of said chute adjacent to said convex strip, said mating surface of said first fastener being located on said convex strip; said second fastener further comprises a rib protruded from a bottom surface of said wide portion, said rib being set in said groove of said first fastener.

11. The sponge fixing mechanism for sponge mop as claimed in claim 4, wherein said chute of said first fastener further comprises a bottom surface facing said upper opening, a distance between said bottom surface of said chute and said upper opening being larger than a distance between the associating said mating surface and said upper opening; said first fastener further comprises two perforations located on said bottom surface of said chute and respectively disposed adjacent to said inlet and said outlet of said chute for the mounting of two connecting rods that are used to move the sponge fixing mechanism.

12. The sponge fixing mechanism for sponge mop as claimed in claim 2, wherein said second fastener comprises a narrow portion and a stop portion located at one end of said narrow portion, a width of said stop portion being larger than a width of said narrow portion; when said first fastener and said second fastener are fastened together, said stop portion of said second fastener is disposed outside said chute and abutted at said inlet of said chute.

13. The sponge fixing mechanism for sponge mop as claimed in claim 12, wherein said second fastener further comprises a slot, a front end, a rear end opposite to said front end, said slot comprising a front wall surface facing said rear end, a rear wall surface facing said front end, and a cantilever disposed in said slot and extending from said front wall surface toward said rear wall surface; said stop portion is located at said rear end of said second fastener; said latching protrusion is located at said cantilever for detachably and elastically engaging into said latching recess by elastic swinging of said cantilever.

14. The sponge fixing mechanism for sponge mop as claimed in claim 2, wherein said chute of said first fastener comprises a bottom surface, a convex strip protruded from said bottom surface, and a groove located on said bottom surface adjacent to said convex strip; said mating surface of said first fastener is located on said convex strip; said second fastener further comprises a rib protruded from the mating surface thereof, said rib being disposed in said groove of said first fastener.

15. The sponge fixing mechanism for sponge mop as claimed in claim 2, wherein said chute of said first fastener further comprises a bottom surface facing said upper opening, a distance between said bottom surface of said chute and said upper opening being larger than a distance of the associating said mating surface and said upper opening; said first fastener further comprises two perforations located on said bottom surface of said chute and respectively disposed adjacent to said inlet and said outlet of said chute for the mounting of two connecting rods that are used to move the sponge fixing mechanism.

* * * * *